US007172165B1

(12) United States Patent
Young

(10) Patent No.: US 7,172,165 B1
(45) Date of Patent: Feb. 6, 2007

(54) TILTING HOLDER FOR RELATED ITEMS

(76) Inventor: Robert P. Young, 7528 S. 2300 East, Salt Lake County, UT (US) 84121

( * ) Notice: Subject to any disclaimer, the term of this patent is extended or adjusted under 35 U.S.C. 154(b) by 73 days.

(21) Appl. No.: 10/984,345

(22) Filed: Nov. 8, 2004

Related U.S. Application Data

(60) Provisional application No. 60/518,123, filed on Nov. 7, 2003.

(51) Int. Cl.
*A47F 5/00* (2006.01)

(52) U.S. Cl. ..... 248/314; 211/10; 220/528

(58) Field of Classification Search ..... 248/311.2, 248/314; 211/10, 120, 69.1, 126.1, 133.6; 206/361, 362, 561; 220/528, 736
See application file for complete search history.

(56) References Cited

U.S. PATENT DOCUMENTS

| | | | | |
|---|---|---|---|---|
| 715,287 | A | 12/1902 | Paine | |
| 780,443 | A | 1/1905 | Phillips | |
| 2,084,162 | A | 6/1937 | Packard | |
| 2,596,009 | A | 5/1952 | Connor | |
| 2,945,251 | A * | 7/1960 | Eichner | 15/104.92 |
| 3,984,046 | A * | 10/1976 | McMahon | 229/120.25 |
| 4,015,940 | A * | 4/1977 | Conlon | 422/104 |
| 5,137,151 | A * | 8/1992 | Choate | 206/370 |
| 5,649,634 | A * | 7/1997 | Irizarry | 211/120 |
| 5,772,163 | A | 6/1998 | Young | |
| 5,816,418 | A * | 10/1998 | Hsu | 211/120 |
| 6,234,327 | B1 | 5/2001 | Reed | |
| 6,953,128 | B2 * | 10/2005 | Pfister et al. | 220/507 |

* cited by examiner

*Primary Examiner*—Ramon O Ramirez
(74) *Attorney, Agent, or Firm*—Thorpe North & Western, LLP

(57) ABSTRACT

A holder for related items used in an activity where such items are likely to be used, includes a substantially planar base to be placed on a surface and an open top receptacle hinged to the base so that the receptacle can be tipped about the hinge with respect to the base. The hinge is positioned substantially along a lower side edge of the receptacle and provides resistance to tipping movement of the receptacle so a user can tip the receptacle with respect to the base and the receptacle will maintain the tipped position until readjusted by the user. A divider unit is preferably removably positioned in the receptacle to divide the receptacle into sections for organizing and holding items to be held. A coil spring has ends attached to the receptacle so that the spring assumes an arcuate position extending from a side of the receptacle to receive and hold elongate items. One top side edge of the receptacle may be lower than the other top side edges with the edges adjoining the lower side edge angled downwardly from an intermediate location along those edges. The lower edge provides a side of the receptacle for shorter items or for items to hang over the edge.

21 Claims, 2 Drawing Sheets

TILTING HOLDER FOR RELATED ITEMS

RELATED APPLICATIONS

Figure 1:
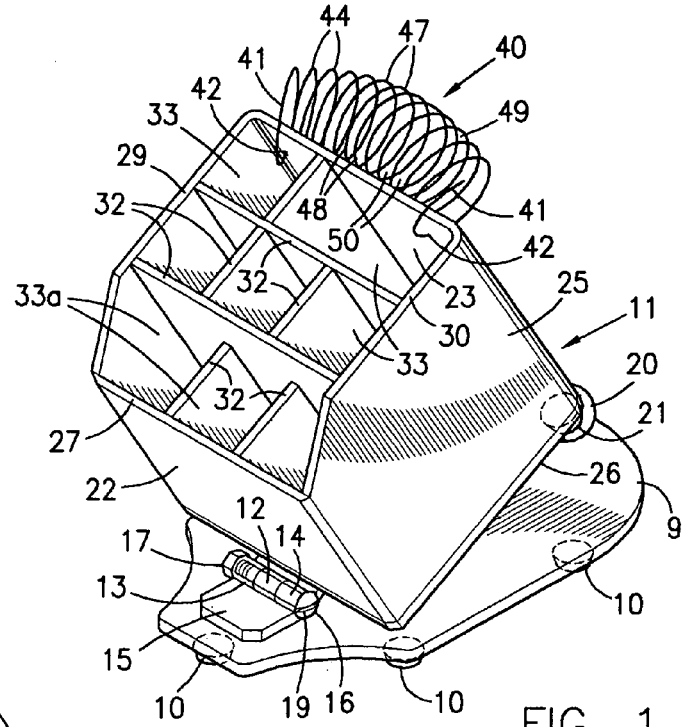

This application claims the benefit of Provisional Application No. 60/518,123, filed Nov. 7, 2003, entitled "Tilting Cosmetic Accessory Holder."

BACKGROUND OF THE INVENTION

1. Field

The invention is in the field of holders for related items used in an activity where such items are likely to be used such as in doing nails, particularly in nail salons, where items to be available for use include items such as nail files, scissors, clippers, nail polish and nail acrylic brushes, cuticle pushers, orangewood sticks, etc.

2. State of the Art

In many activities, a number of separate items are used in performing the activity. For example, in doing nails, items such as nail files, scissors, clippers, nail polish and acrylic brushes, cuticle pushers, orangewood sticks, etc. are used at various time. In dental laboratories in making crowns, various tools such as various files and scrapers are used. The person performing the activity has to retrieve the desired item when needed, replace the item after use, retrieve another desired item, and continue retrieving and replacing different and the same items as they are needed, used, and then needed again. Often the items to be used are kept together in a box or other container wherein it is difficult for a user to easily find and retrieve a needed items. Sometimes the items are spread out on a table or counter top, where, again, it is difficult for a user to easily locate and retrieve the items. Further, in such instances, the items usually have to be removed from a storage container and spread on the counter before use and then put back into the storage container after use.

My U.S. Pat. No. 5,772,163 shows a device for holding and tipping a container of liquid such as a nail polish container. Such device includes a base to be placed on a surface, a receptacle for holding the container, and a hinge joining the receptacle to the base substantially along a side of the receptacle. The receptacle can be rotated or tipped about the hinge to tip the receptacle and the container in the receptacle to a desired angle and the receptacle will maintain the tipped position until again moved by the user. The receptacle is lined with a resilient and compressible material such as plastic foam so that containers of various shapes and sizes may be inserted into the receptacle and held by the compressed material. The holder shown in the patent holds and tips a single bottle fit into the holding foam in the receptacle.

U.S. Pat. No. 780,443 shows a letter rack including an arcuate coil spring where letters can be placed between the coils of the spring and held there between respective coils.

It would be desirable to have items used in performing a particular activity organized and held in an easily accessible and tippable holder.

SUMMARY OF THE INVENTION

According to the invention, a receptacle or container for holding items to be used in performing an activity includes a receptacle for receiving and holding items and a spring extending in an arc from the receptacle for holding a handle of an elongate item suspended in the air so that the ends of the suspended item, such as a wet applicator brush, do not rest on a surface. In a preferred embodiment of the invention, a receptacle or container having an open top is hingedly secured along one bottom edge to a base so that the container can be tipped and remains in the tipped position to provide easy access to a user to the items stored in the container. The container preferably includes a divider therein to divide the interior of the container into compartments. If the divider is a removable unit, it can be removed for easy cleaning of the receptacle, or for replacement by other divider unit having other divider arrangements. The receptacle may be of various sizes depending upon the intended use. A three and one half inch square receptacle of about four inch depth has been found satisfactory for nail care items and other cosmetic items. With the three and one half inch square receptacle, an elongate base of six and one half inches by three and three quarter inches has been found satisfactory. The base preferably includes a weight means, such as a metal ball, and a non-slip material or non-slip feet on the bottom, to stabilize the base on a supporting surface. The construction and hinged attachment of the receptacle to the base is as described and shown in my referenced U.S. Pat. No. 5,772,163, which is incorporated herein by reference. One side of the receptacle can be made lower than the other sides for storage of shorter items or items that straddle the side.

The receptacle includes a spring along one side, preferably along one top side, which can receive elongate items, such as brushes and pencils, and hold such items easily available between adjacent coils of the spring.

DRAWINGS

Figure 2:
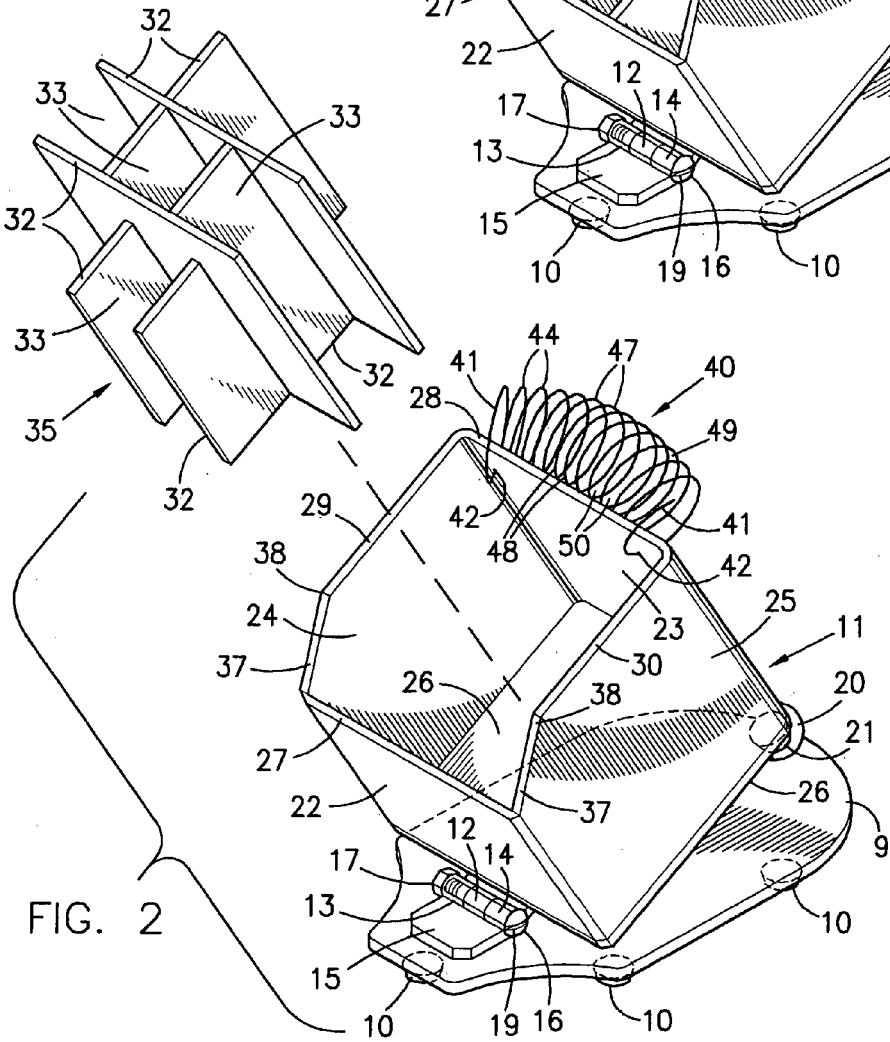
Figure 4:
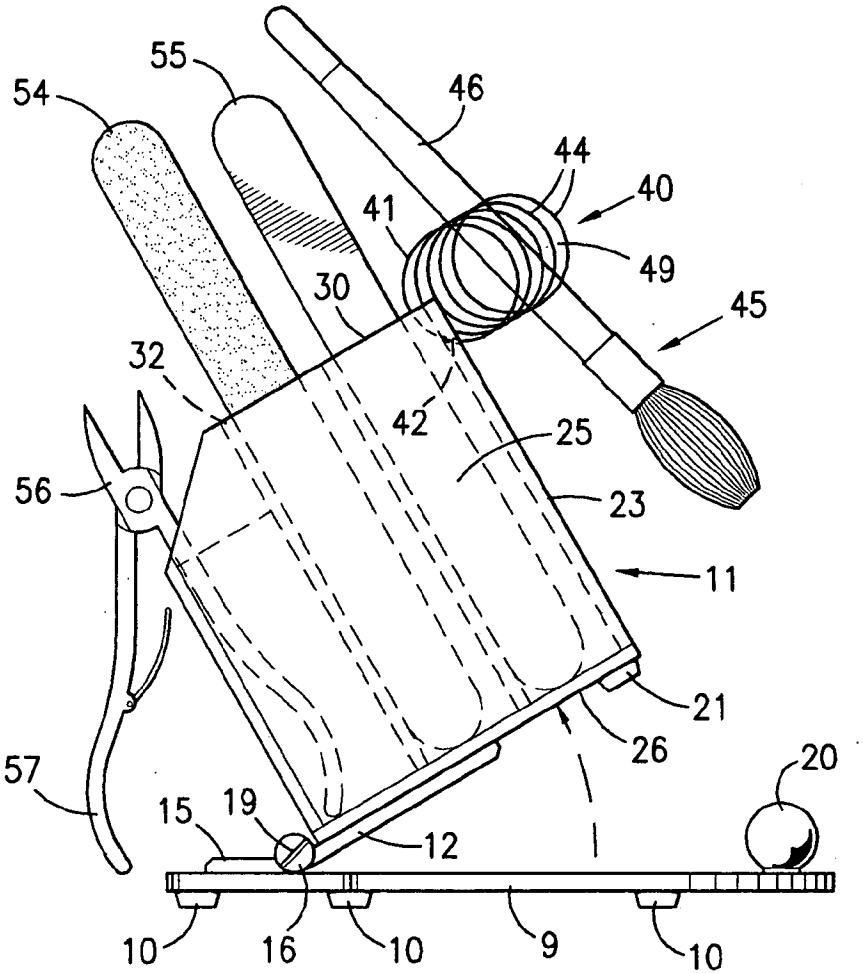
Figure 3:
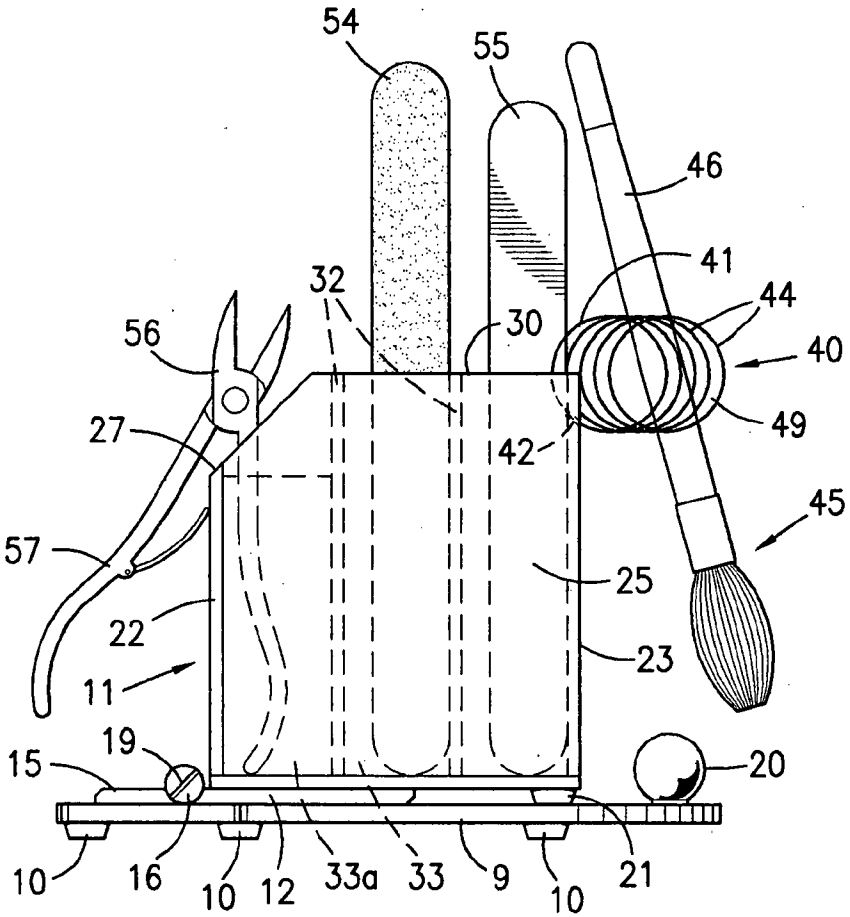

The best mode currently contemplated for carrying out the invention in actual practice is illustrated in the accompanying drawings, in which:

FIG. 1 is a pictorial view of a holder for related items of the invention;

FIG. 2, a similar pictorial view showing the dividers as a removable unit removed from the receptacle of the holder;

FIG. 3, a side elevation of the holder of FIG. 1 with the items held in the receptacle and spring and the receptacle in untipped position; and FIG. 4, a side elevation similar to that of FIG. 3, but showing the receptacle in a tipped position.

DETAILED DESCRIPTION OF THE ILLUSTRATED EMBODIMENT

In the illustrated embodiment, the device of the invention includes an elongate base 9 which may be molded of a plastic material, or cut from a sheet of plastic or other material, and has non-slip rubber or cushion plastic feet 10 secured thereto to rest on a surface on which the device is placed. These feet cushion the device on the surface, and stabilizes the device as they resist sliding over the surface.

A receptacle or container, here shown as an open top, square cross-section receptacle 11, is hinged along a lower side thereof to the base 9. Hinge element 12 may be integrally molded with receptacle 11, or attached thereto such as by gluing, to extend laterally outwardly from a lower side thereof and is configured to be received between a pair of receiving hinge elements 13 and 14 extending upwardly from base 9 near an end thereof, and which may be integrally molded with base 9 or which extend upwardly and outwardly from a hinge base 15, which may be molded integrally with base 9 or secured thereto such as by gluing. A screw 16 extends through hinge elements 12, 13, and 14 to keep them together in alignment and serve as the pivot member for the hinge. Nut 17 is tightened to the end of screw 16 to hold it in place. As seen in FIGS. 1 and 2, nut 17 may be a hex nut positioned so that a flat side is substantially against the top of base 9. This prevents nut 17 from rotating as screw 16 is turned. Rather than a nut 17, hinge element 13 could be threaded to receive the end of screw 16, or could have a threaded insert or other type of nut positioned to receive the end of screw 16.

The hinge elements 12, 13, and 14 will preferably be sized and positioned so that element 12 fits closely but easily between elements 13 and 14. With screw 16 and nut 17 loosely tightened, receptacle 11 may be easily rotated about screw 16, but generally will not remain in a tilted position but will fall back to a rest position under the influence of gravity when items are positioned in receptacle 11. However, hinge elements 13 and 14 and base 9 are flexible enough that upon tightening of nut 17 and screw 16, hinge elements 13 and 14 bear against and tighten against hinge element 12 therebetween to increase the friction between the elements. This makes it more difficult to rotate receptacle 11 about screw 16 so that when receptacle 11 is rotated, it will remain in its rotated, tipped position until again moved by a user. In this way, a user can rotate receptacle 11 to any desired position and the receptacle will remain in that position. Nut 17 can be tightened onto screw 16 to any desired degree by the user by means of a normal screwdriver in slot 19 of screw 16 to make it as difficult or as easy as a user desires to rotate receptacle 11.

While hinge elements 12, 13, and 14 are shown as integrally molded with receptacle 11 and base 9, respectively, or secured thereto such as by gluing, it should be realized that other separate hinge pieces forming hinge elements may be used and attached in any suitable manner, such as by fasteners or glue, to base 9 and receptacle 11. However, it is presently preferred that regardless of the hinge used, the tension on the hinge formed be adjustable. In some situations this is not necessary as long as the hinge resists movement to the extent that when the receptacle is positioned by a user, it is held in that tipped position under normal use until moved to another position by the user.

To make the device as stable as possible while still maintaining a relatively small size for the device and lightweight plastic construction, it is desirable to provide additional weight, such as a steel ball 20, positioned on the base at the end opposite the hinge member. This weight and positioning of the weight, has been found to stabilize the device so it will not easily be tipped over if accidently hit, and, in conjunction with the non-slip feet 10, maintains the position of the device on a surface during normal use of the device. Any shape decorative weight could be used. An eleven-sixteenth inch stud ball bearing has been found satisfactory for the weight.

While the flat bottom of receptacle 11 could rest directly on the top of base 9 when receptacle 11 is in upright, untilted position, FIG. 3, it is presently preferred to provide two supporting feet 21 along the bottom of receptacle 12 to contact the top of base 9 and support receptacle 11 thereon.

Receptacle 11 may take various shapes and is shown in its currently preferred shape as an open top rectangular receptacle with opposite sides 22 and 23 and 24 and 25 forming a square cross section and with a bottom 26 from which the sides extend to form a closed bottom. Sides 22–25 have top edges 27–30, respectively, defining the receptacle top opening. Receptacle 11 includes dividers 32, FIG. 1, therein to provide a plurality of separate compartments 33 in the receptacle to hold items therein and to hold such items in one compartment separated from items in other compartments. This makes it easy for a user to see particular items and to retrieve such items. The dividers can be supplied as a removable divider unit 35, FIG. 2, so that a user can easily remove the dividers by removing the divider unit 35 to clean the receptacle or for replacing the divider unit 35 with other divider units of differing configurations. In this way, the receptacle 11 can be easily configured in a variety of arrangements as desired by the user for particular activities. The dividers are shown as a plurality of transverse connected straight walls 32 which form rectangular compartments 33, but could contain walls at various angles or curved walls to form various shaped compartments depending upon the intended activity to be performed and the particular items needed for that activity. The dividers could also include a top with various sized and shaped openings therethrough for receiving and separating the various items to be held.

For some activities, such as nail care activities, it is preferred that the receptacle have one side edge, here shown as side edge 27 of side 22, lower than the other edges (side 22 is shorter than the other sides) with opposite side edges 29 and 30 adjoining the lower edge 27 cut at an angle to angle downwardly, as at 37, from an intermediate location 38 along each of those edges 29 and 30 to the lower edge 27. The lower edge 27 provides easy access to items stored along this edge and allows shorter items to be stored in compartments 33*a* along this edge. This shorter edge 27 is preferably along the hinged side 22 of the receptacle, as shown. This is the bottom side of the open top of receptacle 11 as the receptacle is tipped.

A coil spring 40 is attached to extend from a side of the receptacle, here shown as side 23, in an arcuate orientation across the side and preferably positioned along top edge 28. Spring 40 may be attached to side 23 by inserting spring end portions 41 into spring receiving holes 42 in side 23. Spring 40 receives and holds elongate items, such as brushes and pencils, between adjacent coils 44. The spring size is chosen so that adjacent coils 44 are spaced appropriately to receive and hold items to be used for the anticipated activity. Thus, for nail care activity where brushes 45, FIGS. 3 and 4, for applying acrylic material to nails to build up the nails are expected to be used, or special brushes are expected to be used for applying nail polish, the spacing between adjacent coils is selected to accept and hold the handles 46 of such brushes. The arcuate configuration of coil spring 40 spreads the outer sides 47 of respective coils 44 farther apart than the inner sides 48 of the respective coils so that an item, such as a brush handle 46, to be held between the coils 44, can be easily inserted into the space 49 between adjacent coil outer sides 47 along the outer side of the arc formed by spring 40. The adjacent coils 44 will grip the item as the item is moved into the diminishing width space 50 between the adjacent coils 44 as the item moves into space 50 and toward the inner sides 48 of the spring coils 44 toward the receptacle 11 along the inner side of the arc formed by spring 40. The spring may be a stainless steel spring or may be made of piano wire or other spring material, and is preferably coated with a synthetic rubber or other plastic material to increase the friction between the spring coils and an item to be held by the coils to increase the holding power of the spring coils. The plastic coating has been found very effective to increase the holding power of the spring. Preferably spring 40 extends along the side, here side 23, which is the side opposite the side which is hinged to the base, here side 22, so that spring 40 is above the top of the receptacle open top as receptacle 11 is tipped. It should be noted that spring 40 holds an item by the handle intermediate the ends of the item so that the ends of the item do not rest on the bottom of the receptacle or otherwise on a surface as would be the case if the item was placed in the receptacle or on a surface. This is important for items such as brushes that may have acrylic, nail polish, paint, etc. on the brush end of the brush so it is important to support such end above and not in contact with the surface. Further, it is generally desirable to store items such as brushes with the brush end protected against deformation such as caused when stored resting on the brush end.

In use, the holder is conveniently positioned on a working surface. If not already adjusted, screw 16 is adjusted to provide the desired tension on the hinge. Receptacle 111 may be left in a vertical position as shown in FIG. 3, or may be tipped to an extent desired by the user to place it in a convenient orientation for allowing easy access to the items in receptacle 11 and held by spring 40. Receptacle 11 may be rotated, such as to a position shown in FIGS. 1, 2, and 4, to make access to the items held in the receptacle easier for the user. Usually it will be desirable to have the hinge tightened to an extent to hold receptacle 11 in a desired position to which it is tipped until the user readjusts the position.

As shown in FIGS. 3 and 4, various items will be positioned in the receptacle compartments 33 to separate them and make them convenient for a user to easily identify and retrieve. For example, when using the holder to hold nail care items, a particular type and size of nail file 54 may be positioned in one compartment 33, and another type and size of nail file 55 may be positioned in another compartment 33, nail clippers 56 may be positioned in another compartment, such as a compartment 33*a* along lower edge 27 with one side of their handles 57 hanging over lower edge 27, and brushes 45 for applying acrylic material, nail polish, or other material to the nails, and where it is important to keep the brush end of the brush from resting on a surface between uses, are held by the spring 40. Other nail care items, not shown, such as scissors, cuticle pushers, orangewood sticks, etc. will normally be positioned in other of the compartments 33 and 33*a*. In this way, a user can easily see and identify different items and may easily pick up such items when the user desired to use such item and can easily replace such items after use.

The receptacle may be of various sizes depending upon the intended use. A receptacle made of one quarter inch thick plastic with a square cross section of about three and one half inches by about three and one half inches and about four inch deep has been found satisfactory for nail care items and other cosmetic items. With the three and one half inch square receptacle, an elongate base of about six and one half inches by about three and three quarter inches has been found satisfactory. A lower edge formed by a short side about one half inch shorter than the four inches of the other sides, has also been found satisfactory. With the three and one half inch wide sides, spring receiving holes for the ends of the coil spring can be spaced about 2.8 inches apart. With such spacing, a coil spring about three inches long and about 1.2 inches in diameter with coils spaced between about 0.2–0.25 inches apart has been found satisfactory for accepting and holding brush handles or other items between about 0.2 and 0.3 inches in diameter. With the size spring indicated, the arc formed will spread the distance between coils along the outside of the arc forming openings or space 49 to about 0.3 inches and squeeze the distance between the coils along the inside of the arc to about 0.15 inches. Larger diameter items can be received and held between the coils 44 as the larger diameter items will open the space between the coils as the item is inserted into opening or space 49.

It has been found that the holder of the invention is quite stable, resisting tipping over of the holder if accidentally hit during use. Of course, the wider the base, the more resistant to tipping sideways it will be, but with a receptacle sized as indicated above, a base of about six and one half inches by three and three quarter inches has been found satisfactory to provide good stability. Various other dimensions will be satisfactory depending upon the items to be held in the receptacle and the materials used in construction.

While the device has been described as made of plastic material, various other materials can be used. If a heavier material is used for the base, it may not be necessary to add a weight to the base.

Further, while the holder has been shown as a preferred embodiment including the receptacle hinged to a base so it can be tipped to a desired position, with dividers in the receptacle to divide the receptacle into compartments for better organization and separation of the items to be held, and with a spring to hold handles of items where one or both ends of the item is desired to be held in the air rather than resting on a surface, a holder of the invention could be provided with just the receptacle and the spring. Items could then be held in the receptacle and the spring. The tipping allows easier access to the items and the dividers also allow better access to the items through better separation and organization of the items, but are not necessary.

Whereas this invention is here described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

The invention claimed is:

1. A holder for related items used in an activity where such items are likely to be used, comprising:

a substantially planar base to be placed on a surface;

an open top receptacle;

receptacle divider means in the receptacle to divide the receptacle into sections for organizing and holding items to be held in the receptacle;

a coil spring having ends attached to the receptacle so that the spring assumes an arcuate position extending from the receptacle; and hinge means hingedly connecting the receptacle to the base, said hinge means having adjustable resistance to relative movement between the receptacle and the base whereby the receptacle can be tipped by a user with respect to the base about the hinge means and the hinge means adjusted to maintain the receptacle in the tipped position until said tipped position is change by the user.

2. A holder for related items used in an activity where such items are likely to be used, according to claim 1, wherein the divider means is removable from the receptacle.

3. A holder for related items used in an activity where such items are likely to be used, according to claim 2, wherein the container is rectangular with opposite pairs of top side edges defining the open top of the receptacle, and wherein one top side edge is lower than the other top side edges.

4. A holder for related items used in an activity where such items are likely to be used, according to claim 3, wherein top side edges adjoining the lower top side edge angle downwardly from an intermediate location along those top side edges to the level of the lower top side edge where they join the lower top side edge.

5. A holder for related items used in an activity where such items are likely to be used, according to claim 4, wherein the lower edge is along the hinged side of the receptacle.

6. A holder for related items used in an activity where such items are likely to be used, according to claim 5, wherein the coil spring extends along one side of the receptacle.

7. A holder for related items used in an activity where such items are likely to be used, according to claim 6, wherein the coil spring extends along the side of the receptacle opposite the hinged side of the receptacle.

8. A holder for related items used in an activity where such items are likely to be used, according to claim 7, wherein the spring is coated with a friction increasing material.

9. A holder for related items used in an activity where such items are likely to be used, according to claim 8, wherein the friction increasing material is a plastic material.

10. A holder for related items used in an activity where such items are likely to be used, according to claim 9, additionally including:

at least one receptacle hinge element secured to the receptacle at a side of the receptacle adjacent the base;

at least one base hinge element secured to the base; and hinge pin means extending through the respective hinge elements to hingedly and adjustably secure them together, whereby the receptacle is hingedly connected to the base so that the receptacle can be tipped with respect to the base about the hinge pin substantially along a lower side of the receptacle and the resistance to movement of the hinge connection is adjustable.

11. A holder for related items used in an activity where such items are likely to be used, according to claim 1, wherein the container is rectangular with opposite pairs of top side edges defining the open top of the receptacle, and wherein one top side edge is lower than the other top side edges.

12. A holder for related items used in an activity where such items are likely to be used, according to claim 11, wherein top side edges adjoining the lower top side edge angle downwardly from an intermediate location along those top side edges to the level of the lower top side edge where they join the lower top side edge.

13. A holder for related items used in an activity where such items are likely to be used, according to claim 11, wherein the lower edge is along the hinged side of the receptacle.

14. A holder for related items used in an activity where such items are likely to be used, according to claim 1, wherein the coil spring extends along one side of the receptacle.

15. A holder for related items used in an activity where such items are likely to be used, according to claim 1, wherein the coil spring extends along the side of the receptacle opposite the hinged side of the receptacle.

16. A holder for related items used in an activity where such items are likely to be used, according to claim 1, wherein the spring is coated with a friction increasing material.

17. A holder for related items used in an activity where such items are likely to be used, according to claim 16, wherein the friction increasing material is a plastic material.

18. A holder for related items used in an activity where such items are likely to be used, according to claim 1, additionally including:

at least one receptacle hinge element secured to the receptacle at a side of the receptacle adjacent the base;

at least one base hinge element secured to the base; and hinge pin means extending through the respective hinge elements to hingedly and adjustably secure them together, whereby the receptacle is hingedly connected to the base so that the receptacle can be tipped with respect to the base about the hinge pin substantially along a lower side of the receptacle and the resistance to movement of the hinge connection is adjustable.

19. A holder for related items used in an activity where such items are likely to be used, comprising:

a substantially planar base to be placed on a supporting surface;

an open top receptacle for receiving and holding items to be held;

a coil spring having ends attached to the receptacle so that the spring assumes an arcuate position extending from the receptacle for receiving and holding elongate items to be held intermediate the length of the items where it is desired to suspend ends of the items above and not in contact with the supporting surface; and hinge means hingedly connecting the receptacle to the base, said hinge means having adjustable resistance to relative movement between the receptacle and the base whereby the receptacle can be tipped by a user with respect to the base about the hinge means and the hinge means adjusted to maintain the receptacle in the tipped position until said tipped position is change by the user.

20. A holder for related items used in an activity where such items are likely to be used, according to claim 19, wherein the spring is coated with a friction increasing material.

21. A holder for related items used in an activity where such items are likely to be used, comprising:

a substantially planar base to be placed on a surface;

an open top receptacle;

receptacle divider means in the receptacle to divide the receptacle into sections for organizing and holding items to be held in the receptacle; and hinge means hingedly connecting the receptacle to the base, said hinge means having adjustable resistance to relative movement between the receptacle and the base whereby the receptacle can be tipped by a user with respect to the base about the hinge means and the hinge means adjusted to maintain the receptacle in the tipped position until said tipped position is change by the user.

* * * * *